United States Patent [19]

Bonino et al.

[11] Patent Number: 4,982,934

[45] Date of Patent: Jan. 8, 1991

[54] REHEATING, HOLDING AND ACCUMULATION FURNACE FOR STEELWORKS PRODUCTS

[75] Inventors: Stefano F. S. Bonino, Milan; Nicola B. Cavero, Genoa, both of Italy

[73] Assignees: Pomini Farrell S.p.A., Gastellanza; Italimpianti S.p.A., Genoa, both of Italy

[21] Appl. No.: 324,515

[22] Filed: Mar. 16, 1989

[30] Foreign Application Priority Data

Apr. 1, 1988 [IT] Italy ..... 20091 A/88

[51] Int. Cl.[5] ..... C21D 9/00

[52] U.S. Cl. ..... 266/105; 266/249; 432/239

[58] Field of Search ..... 266/112, 105, 274, 249; 432/239

[56] References Cited

U.S. PATENT DOCUMENTS 3,599,944 8/1971 Erixson ..... 432/239
4,289,944 9/1981 Reese ..... 432/239
4,441,698 4/1984 Limque et al. ..... 266/274

*Primary Examiner*—S. Kastler
*Attorney, Agent, or Firm*—Finnegan, Henderson, Farabow, Garrett & Dunner

[57] ABSTRACT

A reheating, accumulation and holding furnace for blooms comprises a first section in which the blooms are moved along a runway by a first pusher, and a second section in which said blooms are moved by the lift and shifting movement of longitudinal members parallel to the direction of movement of the blooms. Said longitudinal members are constructed with two different surface heights and are mobile at two different levels. At the lesser level only those blooms in a central position in the furnace are reached and moved, whereas at the greater level all the blooms present on the longitudinal members are reached and moved. The combination of bloom movements obtained by the pusher and the two different heights of the longitudinal members determines the passage, accumulation and de-accumulation of the blooms within the furnace.

8 Claims, 4 Drawing Sheets

DEACCUMULATION CYCLE

REHEATING, HOLDING AND ACCUMULATION FURNACE FOR STEELWORKS PRODUCTS

BACKGROUND OF THE INVENTION

In steel mills which operate on a continuous or semi-continuous cycle there is a considerable requirement to maximize gross margins both by reducing transformation costs and by increasing the finished product/raw material yield.

For this purpose a production process is used in which the finished and semifinished mill products are obtained from the liquid ladle steel without any intermediate cooling. In such a process, the liquid steel produced by an electric furnace or converter is cast into semifinished products in a continuous casting machine.

Instead of undergoing cooling and storing for subsequent conditioning, heating and rolling, these semifinished products are fed directly to a reheating and equalization furnace and from here to rolling.

However, as the continuous casting machine and rolling mill have different production rates and different down-time requirements it is necessary in this production method to include a holding furnace between the two machines to allow the temporary storage of the semifinished products arriving from the continuous casting machine and create a sort of "buffer" between them. In this manner any stoppage of one of the two machines is made less serious for the overall production plant.

In this respect, if for example rolling has to be temporarily suspended (because of a fault, for changing the train dimensions etc.) the semifinished products arriving from the continuous casting machine can be temporarily stored in said holding furnace without the need to interrupt casting. Likewise, a temporary halt in casting can be absorbed by feeding the rolling mill with the semifinished products stored in the holding furnace during this stoppage.

For the requirements of the production process a second furnace known as a reheating and equalization furnace is combined with said holding furnace to thermally treat the products leaving the holding furnace or arriving directly from the continuous casting machine before they are fed to rolling.

In general, the holding furnace is installed in parallel with the reheating and equalization furnace for reasons of plant layout and operational simplification.

However, this arrangement necessary implies a mixing-up of the individual semifinished products when the previously accumulated semifinished products are to be de-accumulated.

Such mixing-up can be unacceptable if totally reliable product identification must be maintained, such as may be necessary in the production of small batches with special characteristics. The overall object of the present invention is to obviate the aforesaid drawbacks by providing a furnace which alone performs the holding, reheating and equalization functions and in which the entering semifinished products are kept in rigid sequence until their exit from it.

SUMMARY OF THE INVENTION

Said object is attained by a furnace for the reheating, holding and accumulation of semifinished products, characterised by comprising in combination and in sequence first means for moving said semifinished products in a row with continuous movement, second means for moving said products in sequence in discrete steps, and third means for moving said semifinished products in sequence with discrete steps.

BRIEF DESCRIPTION OF THE DRAWINGS

The present invention and its advantages over the known art will be more apparent from the description given hereinafter with reference to the accompanying drawings in which.

DETAILED DESCRIPTION OF THE INVENTION

Figure 1:
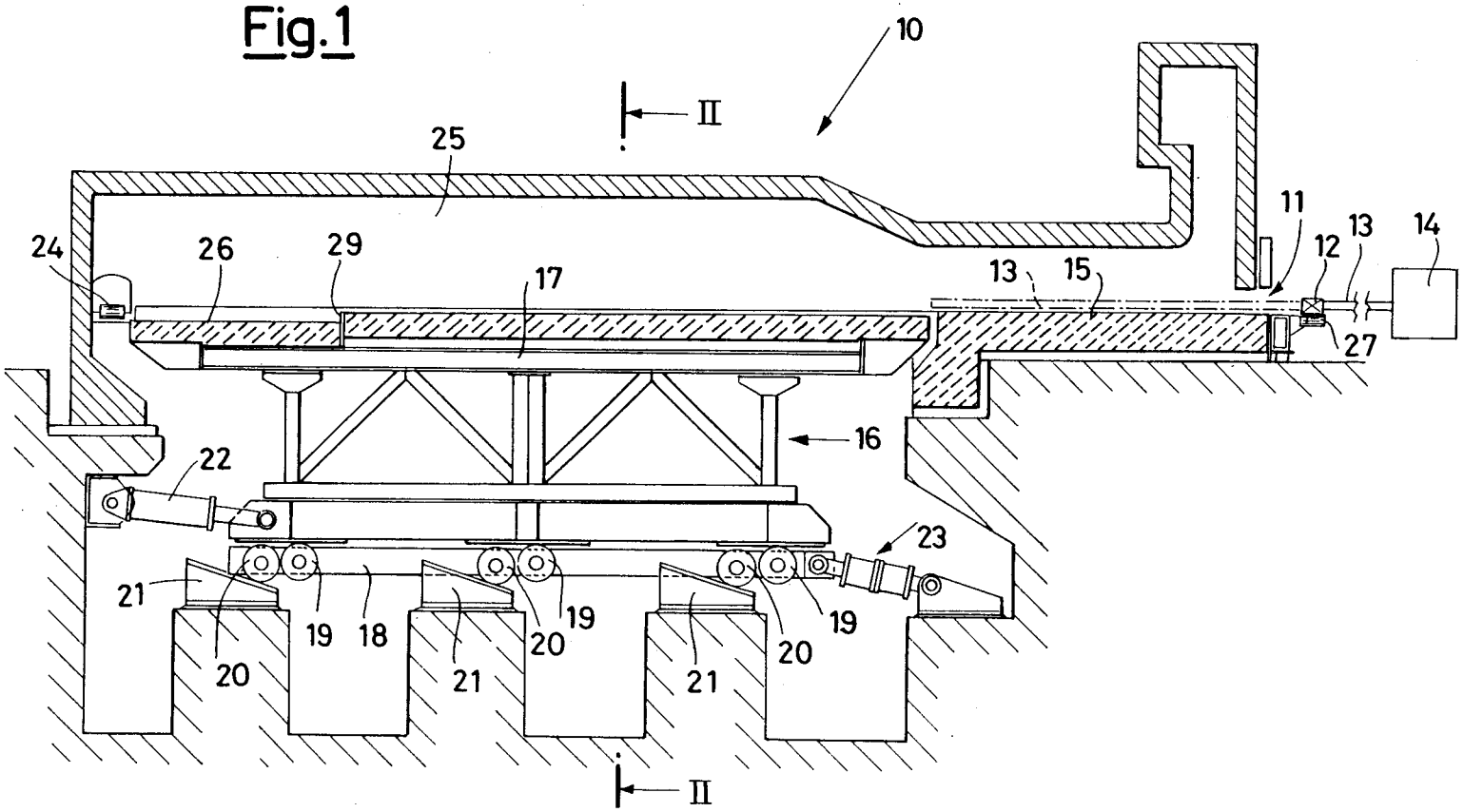
FIG. 1 is a diagrammatic side elevation of a holding, reheating and equalization furnace constructed in accordance with the principles of the present invention.

With reference to the drawings, and as shown diagrammatically in FIG. 1, a holding, reheating and equalization furnace 10 constructed in accordance with the principles of the present invention comprises an entry mouth 11 through which the blooms 12 are inserted into the furnace by a pusher 13 operated by a hydraulic system 14 (not described in detail as it can be of any known type), having been brought into correspondence with said mouth and said pusher by a first roller table 27.

That part of the furnace immediately following the mouth 11 is known as the pushing section and is composed of a horizontal runway 15.

Said pusher 13 is mobile continuously between a first retracted position and a second extended position shown by full line and dashed line in FIG. 1 respectively.

Figure 2:
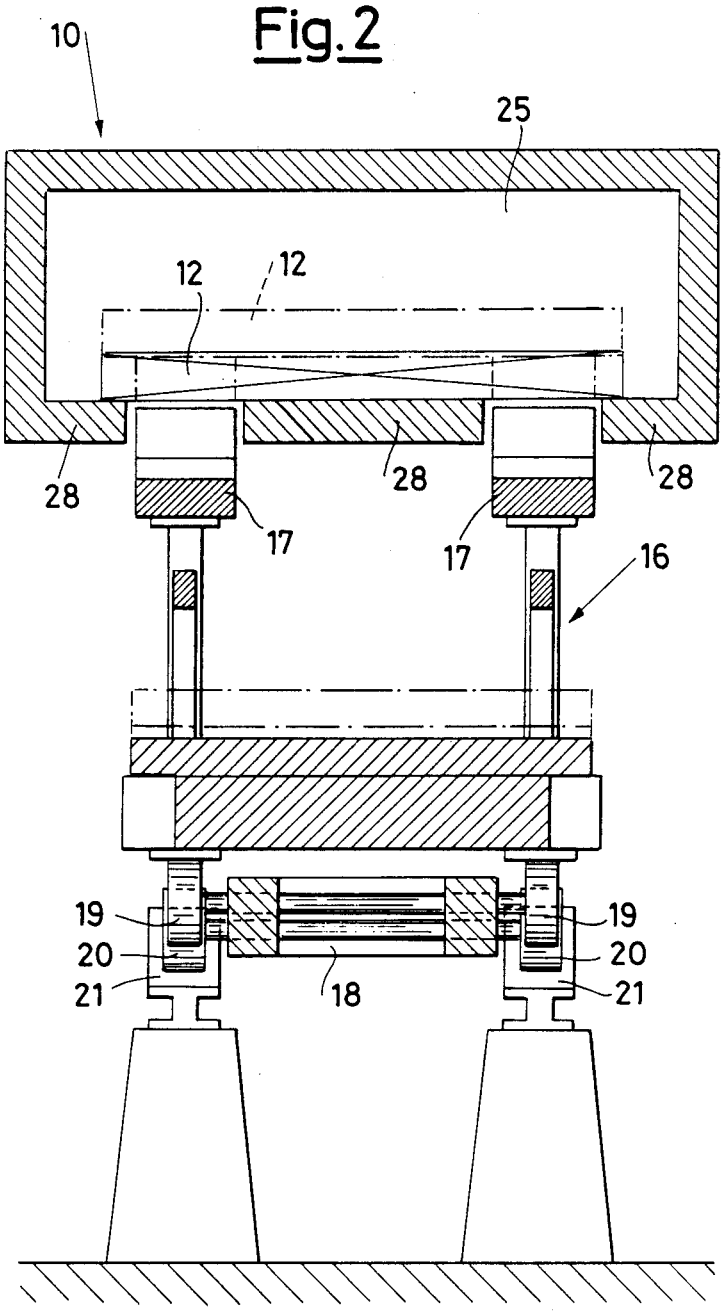
FIG. 2 is a section on the line II—II of FIG. 1.

That part of the furnace immediately following the pushing section is known as the longitudinal member section and comprises a mobile frame 16 carrying the longitudinal members 17. Said longitudinal members, which are parallel and are two in number (as can be seen in FIG. 2), comprise a step 29 and thus a lower surface part 26, as shown in FIG. 1.

Said mobile frame 16 rests on a carriage 18 having two sets of wheels. The first set of wheels 19 supports the mobile frame 16 and the second set of wheels 20 supports said carriage 18 on a plurality of inclined surfaces 21 fixed to the ground.

The mobile frame 16 is driven horizontally on said first set of wheels 19 by a first hydraulic actuator 22 arranged to provide a horizontal thrust between said frame and the ground. In this manner the frame is continuously mobile between a first position in which the right hand end of the longitudinal members 17 is in proximity to the left hand end of the runway 15 (with reference to FIG. 1) and a second position in which the left hand end of the longitudinal members 17 is immediately below the second roller table 24.

The carriage 18 is driven on said second set of wheels 20 along said plurality of inclined surfaces 21 by a second hydraulic actuator 23 arranged to provide a substantially horizontal thrust between said carriage and the ground. The carriage 18 is therefore continuously mobile between a first position in which each wheel of the second set of wheels 20 rests on the lower part of the corresponding inclined surface 21, a second position in which each wheel of the second set of wheels 20 rests on the central part of the corresponding inclined surface 21, and a third position in which each wheel of the second set of wheels 20 rests on the upper part of the corresponding inclined surface 21. With said first, second and third position of the carriage 18 there correspond for the longitudinal members 17 a first position (shown in FIG. 1 and, more clearly, in FIG. 2 in full lines) in which their upper surface is below the level of the furnace floor 28, a second position, of medium lift, in which only that part of the upper surface before the step, i.e. the higher surface, is above the level of the floor, and a third position, of maximum lift, in which said upper surface of said longitudinal members 17 is totally above the level of said floor 28 respectively. At that end of the furnace distant from the entry mouth and close to the termination of the surface of the longitudinal members there is a second roller table 24, extending away from the furnace, to convey the arriving blooms out of the furnace. The actual furnace chamber, which extends between said entry mouth and said roller table and is indicated by the reference numeral 25 on the drawings, and all the structures forming part of a furnace installation such as burners, circulation ducts for combustion products and any waste heat boilers, will not be described in detail as they are of known type and immediately accessible to any expert of the art.

All surfaces within the furnace exposed to heat such as the upper surfaces of the longitudinal members 17 and the runway 15 are faced with a suitable refractory material as is obvious for the particular application.

Said hydraulic means 14 for operating the pusher 13 and said first and second hydraulic actuators 22, 23 respectively are fed by a conventional hydraulic system of known type and therefore not shown on the drawings or described in detail.

The operation of the described furnace is as follows.

In the rest position both the carriage 18 and the frame 16 are in said first position and therefore the longitudinal members are in the position shown in FIG. 1.

It will be initially assumed, for simplicity of description, that only one bloom reaches and passes into the furnace. This bloom arrives at the furnace entry mouth 11 conveyed by the roller table 27 connected typically to the exit of a continuous casting machine.

When it reaches the mouth 11 the bloom is pushed by the pusher 13, operated by the hydraulic means 14 so as to extend into the furnace, as far as the left hand end of the runway 15 (as shown in FIG. 1) and immediately above the right hand end of the longitudinal members 17.

In this position the bloom can be picked up and moved by the longitudinal members which on rising, by virture of the movement of the carriage from its said first position to its said second position, lift the bloom from the furnace floor and, by the subsequent passage of the mobile frame from its said first position to its said second position, shift it through one position towards the furnace exit. By the return of the carriage to its first position the longitudinal members are lowered to rest the bloom on the furnace floor 28 in said shifted position. In this manner the bloom is subjected to a medium-lift shifting movement along the longitudinal members.

By repeating this sequence of movements several times the bloom is shifted through one position each time towards the furnace exit until it reaches the position immediately following the step 29 when the mobile frame is moved into its said first position. Having reached the position immediately following the step 29, the bloom can no longer be moved by the higher part of the longitudinal members 17 and therefore any repetition of the raising of the carriage from its first position to its second position and the shifting of the mobile frame from its first position to its second position no longer contributes to the movement of said bloom. Consequently, the arrival of a second bloom at the furnace mouth 11 along the roller table 27 and its subsequent movement firstly onto the runway by the pusher and then under the previously described combined movement of the carriage 18 and mobile frame 16, leaves the position of the first bloom unchanged although said second bloom advances within said furnace. To cause the first bloom to also advance, the rising movement of the carriage 18 before the shifting movement of the mobile frame 16 must be prolonged until it reaches its said third position so that the lower part 26 of the surface of the longitudinal members 17 can also rise above the furnace floor to thus lift the first bloom. In this manner the blooms are subjected to a maximum-lift shifting movement along the longitudinal members.

Three different-movement regions can therefore be defined within the furnace.

The first region is that coinciding with the runway, the blooms moving within it by the action of the pusher 13.

The second region is that coinciding with that part of the longitudinal members 17 extending between the end of said runway and the step 29, the blooms moving within it by the combined action produced by the raising of the carriage 18 between said first and second position and the shifting of the frame 16 between said first and second position as heretofore described, this movement being called hereinafter the medium-lift shifting movement.

The third region is that coinciding with the lower surface part 26 of the longitudinal members 17, the blooms moving within it (together with any present in said second region) by the combined action produced by the raising of the carriage 18 between said second and third position and the shifting of the frame 16 between said first and second position as heretofore described, this movement being called hereinafter the maximum-lift shifting movement.

Because of these three different-movement regions for the blooms, by suitably programming the movements within them it is possible to obtain not only the accumulation and de-accumulation functions of a holding furnace but also the functions of a reheating and equalization furnace.

An illustrative description is given hereinafter of one possible complete operating cycle of a furnace constructed in accordance of the aforegoing furnace description applying the principles of the present invention.

It will be assumed that the furnace is initially completely empty and that the continuous casting machine begins to produce blooms. The first bloom produced is conveyed to the furnace entry on the roller table 27 and is then pushed into the furnace by the pusher until it reaches the beginning of said second region, after which the longitudinal members execute four medium-lift shifting movements on the bloom.

When the next bloom reaches the furnace entry it is also pushed to the beginning of said second region and the longitudinal members execute a further four medium-lift shifting movements. After a total of four blooms have arrived, the first bloom to have entered the furnace will have reached the beginning of said third region and therefore to undergo further movement the shifting movement of the longitudinal members must be at maximum lift. After one of these movements the situation within the furnace is as shown diagrammatically in FIG. 3*a*.

If the blooms continue to move as described heretofore for each successive bloom entry into the furnace, the blooms will pass through the furnace (which will therefore only perform its reheating and equalization function) and then leave it. It will instead be assumed that the blooms are in the positions shown in FIG. 3*a* but it is required to accumulate them within the furnace, for example to allow stoppage of the rolling mill downstream of the furnace itself.

In such a situation the conveying system within the furnace composed of the pusher and longitudinal members must provide for accumulating the blooms arriving from the continuous casting machine while awaiting restart of rolling.

To achieve this, each bloom arriving from the casting machine is pushed by the pusher 13 as far as the end of the runway. For each bloom pushed into this position the longitudinal members execute only one medium-lift shifting movement on the blooms so that, although the blooms are moved into said second region, the blooms are not moved into said third region so interrupting bloom exit from the furnace. After four such movements the position of the blooms will have passed from that of FIG. 3*a* to that of FIG. 3*b*, and their number in the furnace will have increased to nine blooms.

Figure 3:
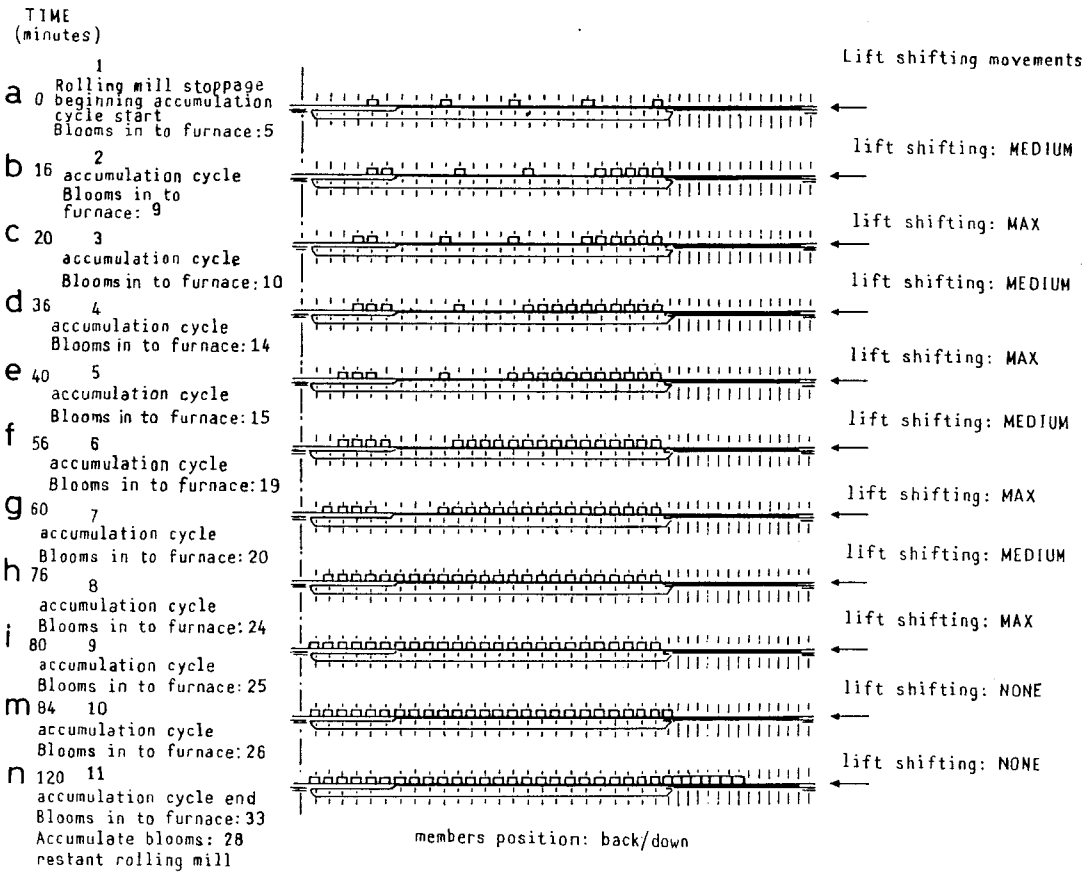
FIG. 3 is a diagrammatic representation of the progress of a semifinished product accumulation cycle within the furnace of FIG. 1.

On arrival of the next bloom in the initial position of said second region, the longitudinal members execute a maximum-lift shifting movement so moving the position of all the blooms in the furnace towards the exit to obtain the arrangement shown in FIG. 3*c*.

Four medium-lift shifting movements are now executed (one for each new bloom arriving) to move only the blooms present in said second region until the first of them reaches the initial position of said third region as shown diagrammatically in FIG. 3*d*. On arrival of the next bloom in the initial position of said second region the longitudinal members execute one maximum-lift movement to move all the blooms in the furnace through one position towards the exit and obtain the bloom arrangement shown in FIG. 3*e*. Again, for each bloom entering the furnace one medium-lift shifting movement is executed to reach the condition of FIG. 3*f* (after four blooms).

On arrival of the next bloom in the initial position of said second region the longitudinal members execute one maximum-lift shifting movement to move all the blooms in the furnace through one position towards the exit and obtain the bloom arrangement shown in FIG. 3*g*.

Again, for each bloom entering the furnace one medium-lift shifting movement is executed to reach the condition of FIG. 3*h* (after four blooms).

On arrival of the next bloom in the initial position of said second region the longitudinal members execute one maximum-lift shifting movement to move all the blooms in the furnace through one position towards the exit and obtain the bloom arrangement shown in FIG. 3*i*.

In this manner the second and third furnace region have been completely filled, to accumulate a total of twenty-five blooms within them.

The subsequent blooms arriving from the continuous casting machine are pushed onto the runway by the pusher but without them reaching the beginning of said second region, and are accumulated there to gradually pass from the situation of FIG. 3*m* to the situation of FIG. 3*n* which diagrammatically shows the furnace with its maximum accumulation of thirty-three blooms.

The rolling mill must restart operation by the time this number of blooms has been reached, otherwise the operation of the continuous casting machine must be suspended. The accumulation capacity is however considerable and enables rolling to be suspended for very lengthy times sufficient in the large majority of cases to obviate the cause of the rolling mill stoppage. With a bloom arrival rate of for example one every four minutes, 120 minutes are required to reach a state of maximum accumulation.

In the example, accumulation has been assumed up to the maximum capacity of the furnace, however it is apparent that said accumulation can be interrupted at any moment if the rolling mill is restarted and blooms can be fed to the mill.

It will now be assumed that de-accumulation of the blooms in the furnace is required due to the restarting of the rolling mill. This de-accumulation is described hereinafter starting from the condition in which the furnace is completely full (shown in FIG. 3*n* and repeated in FIG. 4*a*), however the same reasoning is applicable to a de-accumulation procedure starting from any other situation within the furnace.

Figure 4:
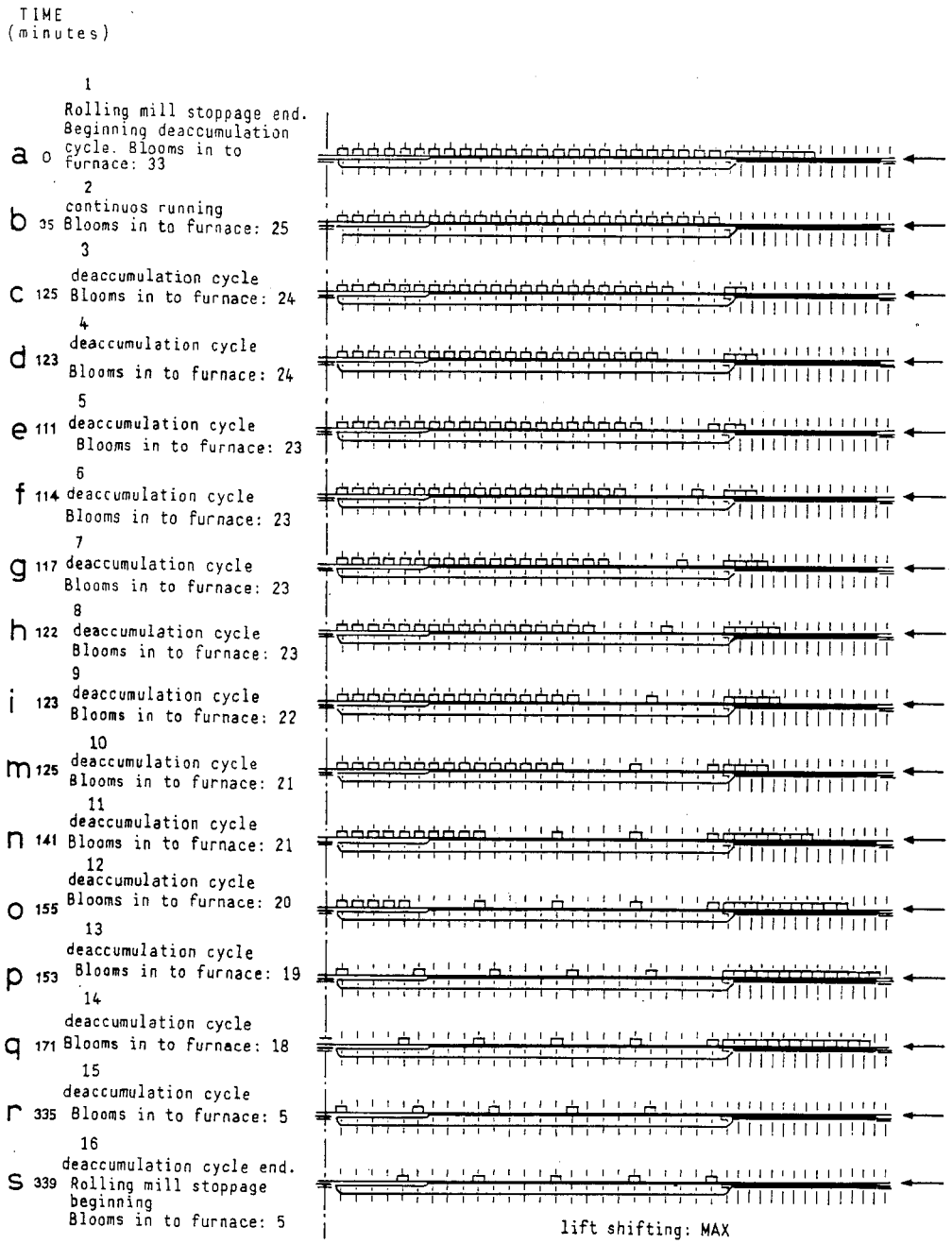
FIG. 4 is a diagrammatic representation of a semifinished product de-accumulation cycle within the furnace of FIG. 1.

Starting from the situation of FIG. 4*a*, for each maximum lift of the longitudinal members one bloom is discharged onto the second roller table 24 leading to the rolling mill, while the blooms present on the runway are moved forward by the pusher so that the first of the row moves into the initial position of the second region to enable it to be shifted by the next movement of the longitudinal members.

Continuing the maximum lift movements in combination with the pusher thrust action, the blooms present in the furnace are discharged in succession onto the roller table and the furnace begins to empty.

In the meantime, blooms arrive from the continuous casting machine (necessarily at a lesser arrival rate than the rate at which they leave for the rolling mill from the furnace exit).

It will be assumed for example that the arrival rate is one bloom every 4 minutes and the desired discharge rate is one bloom every 3 minutes (obtained by moving the longitudinal members at a suitable rate). With these rates, the situation in the furnace 96 minutes after the beginning of the de-accumulation operation will have passed from that of FIG. 4*a* to that of FIG. 4*b*. The number of blooms in the furnace will have passed from thirty-three to twenty-five.

During the three next maximum-lift movements the pusher inserts the blooms arriving at the furnace entry so that they lie in sequence on the runway but without making them reach the beginning of said second furnace region. Thus, during said three maximum-lift movements no new bloom is moved onto the longitudinal members. The situation shown in FIG. 4*c* is thus obtained in which the number of blooms is reduced by one.

At this point the longitudinal members undergo a further maximum-lift movement while the pusher pushes the blooms along the runway (including the bloom which has arrived in the meantime) so that the first of them lies at the beginning of said second region.

The arrangement shown in FIG. 4*d* is thus reached.

The longitudinal members then undergo a further four maximum-lift movements (always one every three minutes) in order successively to pass through the situations shown in FIGS. 4*e*–4*h*, while the pusher pushes the arriving blooms against those present on the runway but without the first bloom in the row which lies on this runway reaching the beginning of said second region.

When the blooms have reached the positions shown in FIG. 4*h*, the longitudinal members undergo a further maximum-lift movement and the pusher then pushes the row of blooms along the runway so that the first of them reaches the beginning of said second region as shown in FIG. 4*i*. The blooms present in the furnace have now decreased to twenty-two.

In FIG. 4*p*, the runway has reached its maximum bloom accumulation capacity, the blooms on the longitudinal members being spaced apart in five positions and the total number of blooms in the furnace being 19.

At this point the movement of the longitudinal members, which previously was once every three minutes, now becomes more frequent so as to continue to discharge one bloom every three minutes in spite of the greater distance between them, whereas the pusher 13 continues not only to position the blooms sequentially in a row along the runway as they arrive from the roller table 27, but also to push the first bloom of said row to the beginning of said second region every five movements of the longitudinal members so that it is moved by the next movement of the longitudinal members as shown for example in FIG. 4*p* and FIG. 4*q*.

After 165 minutes of said more frequent movements of the longitudinal members the situation within the furnace will have passed from that of FIG. 4*q* to that of FIG. 4*r* and the number of blooms in the furnace will have decreased to five, all spaced equidistantly along the longitudinal members.

Each further bloom arriving from the continuous casting machine along the roller table 27 is now pushed by the pusher 13 into the initial position of said second region only when the bloom which had arrived immediately before it is already five positions ahead of said initial position. In this manner, as can be seen in FIG. 4*s*, the spacing between the blooms remains constant and identical to the initial spacing in the aforegoing description of the accumulation stage.

As will now be apparent from the aforegoing description of one example of an accumulation and de-accumulation cycle, the furnace according to the present invention enables considerable flexibility in bloom accumulation and de-accumulation to be obtained, thus resulting in optimized continuous-cycle production in relation to stoppages because of faults or for changing the dimensional characteristics of the rolling mill, or in relation to the use of different operating time bands for the continuous casting machine and rolling mill with the object of obtaining considerable cost savings deriving from the use of preferential electricity tariff time bands.

This is attained while maintaining rigid bloom sequencing at all times on the basis of the first-in, first-out logic used for the conveying system based on the pusher and longitudinal members according to the invention.

The number of blooms which can be accumulated in the described furnace according to the present invention naturally depends on the furnace dimensions and this number can be defined at will according to plant requirements by merely making the furnace of greater or lesser length.

In addition the furnace entry and exit rates can be varied at will by varying the rate of movement of the blooms and their movement sequence within the three said furnace regions.

It is apparent that the implementation of the accumulation and de-accumulation stages heretofore described, together with the rates of execution and the number of blooms processed, are given by way of example only, to clarify the present invention and its advantages compared with the known art.

Any other bloom movement sequence within the described furnace which attains the required purpose can be equally used without this leaving the scope of the present invention.

Finally, although in the aforegoing description the longitudinal member section of the furnace is formed with the surface of said longitudinal members at two different heights to obtain two regions of bloom movement along said longitudinal members, said section can obviously be constructed with longitudinal members of constant surface height but with the furnace floor at two different levels.

We claim:

1. Apparatus in a furnace for the reheating, holding or accumulation of semifinished products during passage through at least three regions of the furnace in sequence comprising in combination first means for receiving said products at the entrance of the furnace and for moving said products in a row with continuous movement through said first region of the furnace to the entrance of said second region, second means for receiving said products at said entrance to the second region and moving said products in sequence in discrete steps through said second region to the entrance of said third region, and third means for receiving said products at said entrance to the third region and for moving said products in sequence in discrete steps through said third region to the exit of the furnace and for discharging said products from said furnace; said first means when activated moving said products independently of said second and third means, said second means when activated moving said products independently of said third means, and said third means when activated moving said products simultaneously with movement of said second means.

2. The apparatus of claim 1, wherein said second means moves the products along a floor of the furnace through said second region in sequence in discrete steps by operating between a first lifting position below the level of the floor and a second lifting position above it and first and second shifting positions, wherein said second means lifts the products off the floor as it raises from its first to its second lifting position, moves them laterally forward as it shifts from its first to its second shifting position, places them back on the floor as it returns to its first lifting position and then returns to its first shifting position.

3. The apparatus of claim 2, wherein said second means comprises a plurality of longitudinal members extending along the length of movement of the products and actuating means for moving the members between said first and second lifting positions and first and second shifting positions.

4. The apparatus of claim 1, wherein said third means moves the products along a floor of the furnace in sequence in discrete steps by operating between a first lifting position below the level of the floor and a third lifting position above it and first and second shifting positions wherein said third means lifts the products off the floor as it raises from its first to its third lifting position, moves them laterally forward as it shifts from its first to its second shifting position, places them back on the floor as it returns to its first lifting position and then returns to its first shifting position.

5. The apparatus of claim 4, wherein said third means comprises a plurality of longitudinal members extending along the length of movement of the products and actuating means for moving the means between said first and third lifting positions and said first and second shifting positions.

6. The apparatus of claim 1 wherein the second and third means move the products along a floor of the furnace through their respective regions and comprises a single movement device comprising a plurality of longitudinal members extending along the length of movement of the products through the second and third regions of the furnace and actuating means for moving the members between first, second and third lifting positions and first and second shifting positions, the upper surface of said members being higher in the second region than in the third, so that when the members move between the first and second lifting positions and the first and second shifting positions only the products in the second region are lifted off the floor and shifted laterally forward in sequence and in discrete steps through said second region and when they move between said first and third lifting positions and the first and second shifting positions, the products in both the second and third regions are lifted off the floor and shifted laterally forward in sequence and in discrete steps through their respective regions.

7. The apparatus of claim 6 wherein said longitudinal members are mounted on a carriage supported by two sets of rollers, a first set for rolling the carriage laterally to shift the members between said first and second shifting positions and a second set that roll on an inclined plane for raising the members between said first, second and third lifting positions.

8. The apparatus of claim 1, wherein the first means comprises a runway for receiving the products and pusher means for pushing the products along the runway to the entrance of the second region.

* * * * *

UNITED STATES PATENT AND TRADEMARK OFFICE

CERTIFICATE OF CORRECTION

PATENT NO. : 4,982,934

DATED : January 8, 1991

INVENTOR(S) : Stefano F. Selva Bonino

It is certified that error appears in the above-identified patent and that said Letters Patent is hereby corrected as shown below:

ON TITLE PAGE:

Page 1, column 1 "Stefano F. S. Bonino" should be --Stefano F. Selva Bonino--

Signed and Sealed this

Fifteenth Day of September, 1992

*Attest:*

DOUGLAS B. COMER

*Attesting Officer*

*Acting Commissioner of Patents and Trademarks*